United States Patent [19]

Hampshire et al.

[11] 4,195,284

[45] Mar. 25, 1980

[54] SOUND GENERATOR

[75] Inventors: Michael J. Hampshire, Liversedge; Norman J. Poole; John Parkes, both of Manchester, all of England

[73] Assignee: Ward & Goldstone Limited, Salford, England

[21] Appl. No.: 823,112

[22] Filed: Aug. 9, 1977

[30] Foreign Application Priority Data

Aug. 11, 1976 [GB] United Kingdom ..... 33341/76
Oct. 20, 1976 [GB] United Kingdom ..... 43466/76

[51] Int. Cl.[2] ..... G08B 3/10

[52] U.S. Cl. ..... 340/384 E; 340/384 R; 340/388

[58] Field of Search ..... 340/384 R, 384 E, 388

[56] References Cited

U.S. PATENT DOCUMENTS

| | | | |
|---|---|---|---|
| 3,277,465 | 10/1966 | Potter | 340/384 R |
| 3,815,129 | 6/1974 | Sweany | 340/388 |
| 3,872,470 | 3/1975 | Hoerz | 340/384 E |
| 3,879,726 | 4/1975 | Sweany | 340/384 E |
| 3,922,672 | 11/1975 | Birt | 340/384 E |
| 4,010,447 | 3/1977 | Podowski | 340/384 E |
| 4,045,954 | 9/1977 | Ganter | 340/384 E |

FOREIGN PATENT DOCUMENTS

| | | | |
|---|---|---|---|
| 958227 | 5/1964 | United Kingdom | 340/384 E |
| 1245714 | 9/1971 | United Kingdom | 340/384 E |
| 1333644 | 10/1973 | United Kingdom | 340/384 E |
| 1368046 | 9/1974 | United Kingdom | 340/384 E |
| 1428589 | 3/1976 | United Kingdom | 340/384 E |
| 1435668 | 5/1976 | United Kingdom | 340/384 E |
| 1480414 | 7/1977 | United Kingdom | 340/384 E |

OTHER PUBLICATIONS

Van Randeraat J. (ed.) "Piezoelectric Ceramics", London, Mullard Limited (1968).

*Primary Examiner*—Harold I. Pitts
*Attorney, Agent, or Firm*—Fleit & Jacobson

[57] ABSTRACT

An open ended can has a piezoelectric crystal attached to its closed end face and contains within it the battery supply and circuitry operative to cause the can to resonate. The can is attached at its open end to a back board through a ring of closed cell foamed synthetic plastics material to form a waterproof enclosure for battery and circuitry. The circuitry is based on one or more CMOS integrated circuits having gates or inverters connected to form one or more oscillators and one of the oscillator pulses the crystal through a transistor power amplifier and step up transformer. That oscillator may be adjusted off the resonant frequency to reduce the output or a feedback path provided to lock the oscillator onto a resonant frequency.

30 Claims, 15 Drawing Figures

V
1

0

1
0
1

0
T

SOUND GENERATOR

BACKGROUND AND SUMMARY OF THE INVENTION

The present invention relates to sound generators, particularly, but not exclusively, to sound generators for fire alarm systems, security systems and the like.

According to one aspect of the present invention there is provided a sound generator comprising a three dimensional body defining a cavity closed at one end and open at the other, a crystal attached to the surface of the closed end and oscillator means operative to pulse the crystal to cause the body to vibrate.

According to another aspect of the present invention there is provided a sound generator comprising a diaphragm, a crystal attached to one face of the diaphragm and oscillator means operative to pulse the crystal to cause the diaphragm to vibrate, the oscillator means comprising at least one CMOS circuit.

In order that the invention may be more clearly understood, one embodiment of the invention will now be described, by way of example, with reference to the accompanying drawings.

DETAILED DESCRIPTION OF THE DRAWINGS

Figure 1:
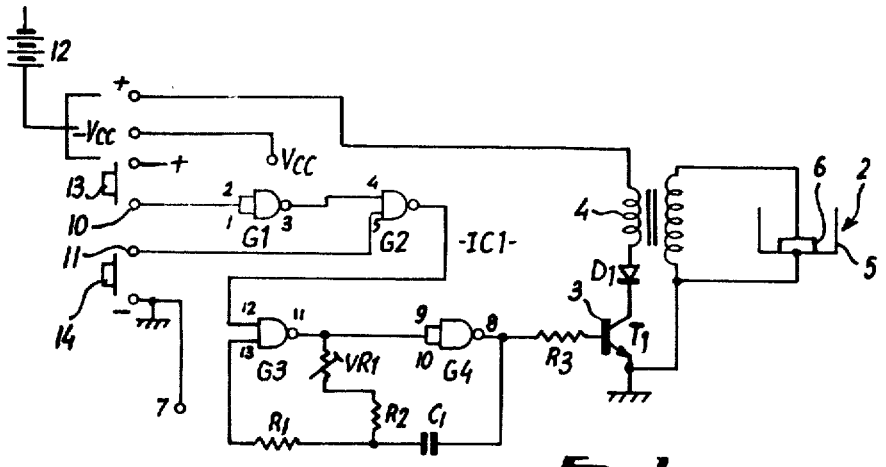
FIG. 1 shows an embodiment employing a single complementary metal-oxide semiconductor (CMOS) integrated circuit.
Figure 1A:
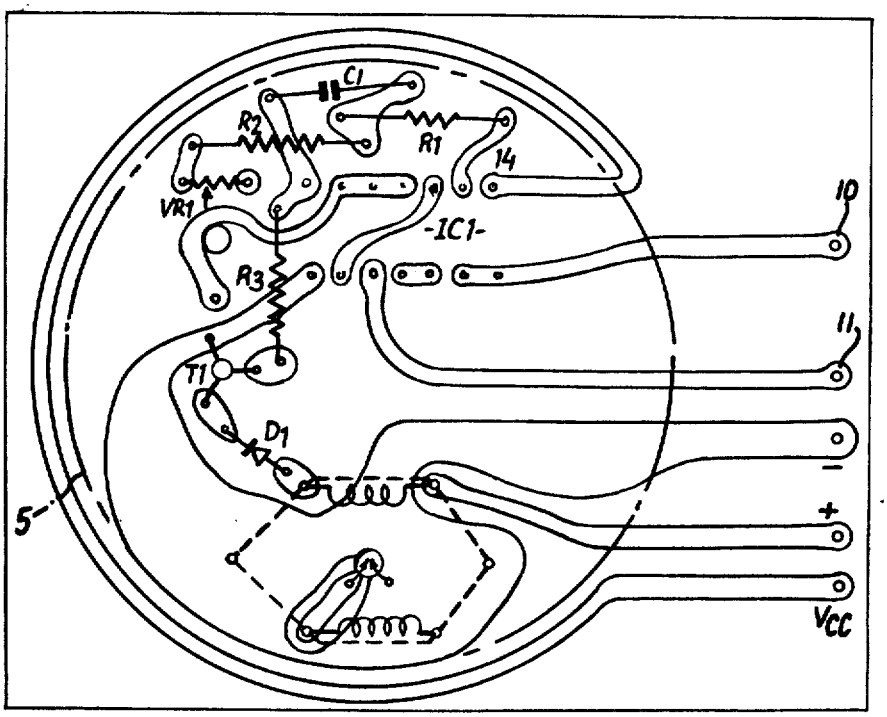
FIG. 1A shows a printed circuit board arrangement appropriate to the circuit of FIG. 1, FIGS. 1B, 1C and 1D respectively show waveforms at three points in the circuit of FIG. 1.

Referring to FIGS. 1 and 1A, the sound generator comprises a CMOS integrated circuit IC1 incorporating four two input NAND gates driving an acoustic device 2 through an NPN transistor 3 and step up transformer 4. The device 2 comprises a brass thin walled cylinder 5 open at one end with a piezoelectric crystal 6 affixed to the internal face of the closed end. The crystal can alternatively be fixed to the external face of the closed end of the cylinder. Materials other than brass such as other metals or plastics material may be used for the cylinder 5. The crystal is bonded to the cylinder by means of a silver loaded solder or a conductive epoxy resin. The electrodes are provided on opposite sides of the crystal one electrode being connected to the earth side of the secondary of the transformer 4 and the other to the live side of the secondary. Of the four gates, referenced G1 to G4 for convenience, gates G3 and G4 form an oscillator oscillating at a frequency dependent upon the values of Resistors $R_1$, $R_2$ and VR1 and capacitor C1, whilst gates G1 and G2 act as on/off switches for the oscillator. Both inputs of gate G1 are tied together and brought out to a terminal 10. The output from gate G1 goes to one input of gate G2 and the other input of gate G2 is brought out to a terminal 11. The generator is supplied from a battery 12. Two push buttons 13 and 14 are provided respectively to connect terminals 10 and 11 to the positive supply terminal of the battery 12 and to earth. Other forms of switching such as electronic switching may be used.

Figures 1B, 1C, 1D:
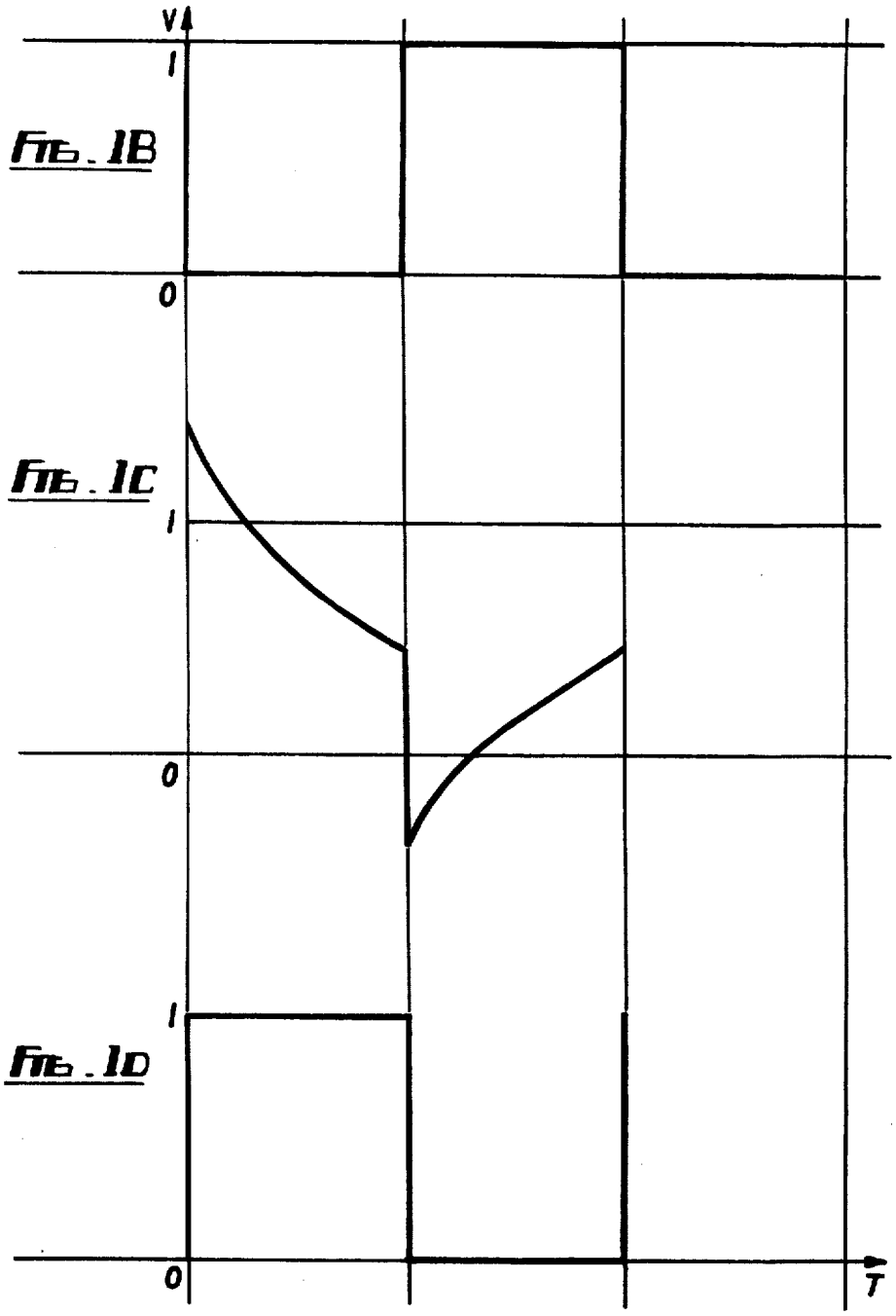

To initiate operation either one or other of the push buttons is depressed. The truth table for a NAND gate is:

| INPUT 1 | INPUT 2 | OUTPUT |
|---|---|---|
| 0 | 1 | 1 |
| 1 | 0 | 1 |
| 0 | 0 | 1 |
| 1 | 1 | 0 |

and considering operation of push button 13 logic 1 is placed on both inputs of gate G1 giving a logic zero at its output and at the first input of gate 2. This produces logic 1 at the output of gate G2 and therefore the first input of gate G3 to enable that gate. The capacitor C1 is considered in the charged condition producing a logic 1 at the second input of the gate G3 and logic zero is produced at the inputs to G4. Capacitor C1 begins to discharge through resistors VR1 and $R_2$ and the voltage at the junction of C1 and $R_2$ falls until the switching point of the gate G3 is reached. At this point the output of gate G3 switches from logic 0 to 1 and that of gate G4 from logic 1 to 0. Because of the switching voltage already present on the capacitor this voltage reversal of the gates G3 and G4 causes the voltage at the junction of $R_2$ with $C_1$ to swing below the zero volts line by an amount approximately equal to the switching voltage. The capacitor C1 then begins to charge in the opposite direction until the switching point is again reached and the logic states on the outputs of the gates G3 and G4 are reversed the voltage at the junction of $C_1$ and $R_2$ then swings up to logic 1 plus the switching voltage at which point the cycle begins to repeat itself. The resultant voltage waveform at the inputs to the gate G4, the connecting point between resistors $R_2$ and capacitor $C_1$ and the output of the gate G4 are shown in FIGS. 1B, 1C and 1D respectively. The waveform of FIG. 1D applied to the base of transistor T1 causes this transistor to be repeatedly switched on and off and the crystal 6 pulsed through the transformer 3 to resonate the can 5 at the pulsing fequency. Small adjustments in frequency can be made by adjustment of variable resistor VR1. Operation is similar using push button 14 a logic 1 being produced at the output of gate G2 by placing a logic zero on the second input (pin 5) of this gate.

Figure 2:
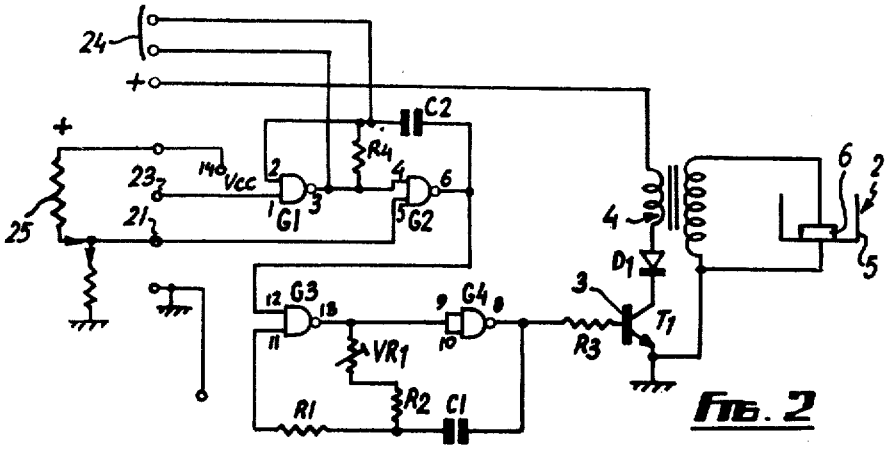
FIG. 2 shows a modification of the embodiment of the circuit of FIG. 1.
Figure 2A:
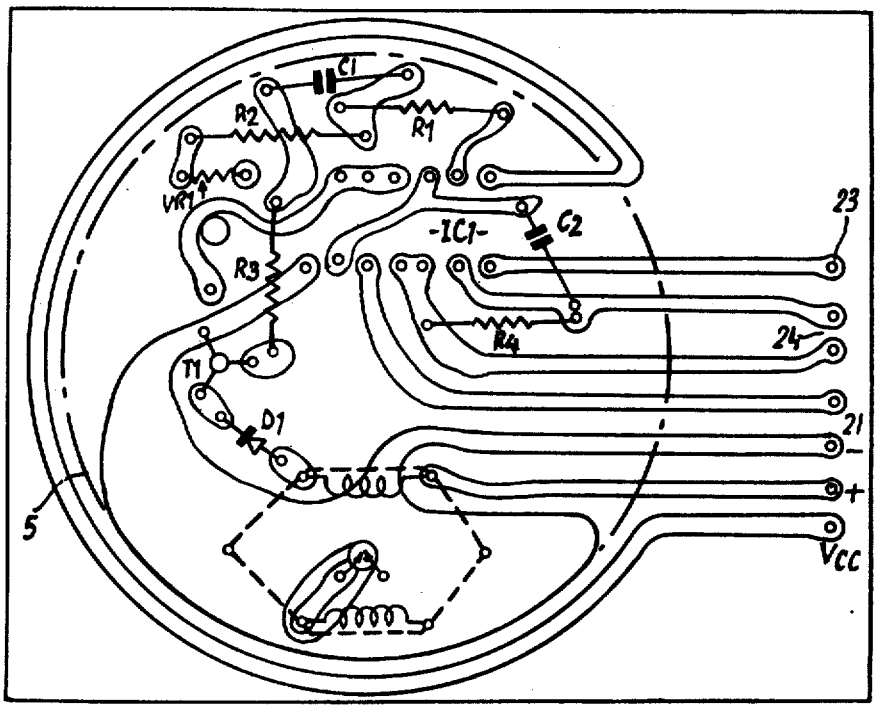
FIG. 2A shows a printed circuit board arrangement appropriate to the circuit of FIG. 2.

Referring to FIG. 2, the previous circuit employing the same CMOS integrated circuit IC1 is modified to provide for a modulated as well as a continuous tone output from the device 2. Effectively, in addition to gates G3 and G4 being interconnected to form a free-running oscillator gates G1 and G2 are also connected together to form a free-running oscillator having an operational frequency less than that of the first mentioned oscillator.

Two operating terminals are provided respectively referenced 21 and 23 for continuous tone and modulated operation. Continuous tone operation is as with the embodiment of FIG. 1 a logic zero being placed on the second input of the gate G2 (pin 5). This results in a logic 1 on the output of the gate G2 and a logic 1 on the first input of the gate G3 (pin 12). Operation of the gate G3 and G4 is then as described for the first embodiment and a continuous tone is produced by the acoustic device 2.

For modulated operation, terminal 23 is connected to the positive Vcc terminal of the integrated circuit placing a logic 1 on the second input of the gate G1. Gates G1 and G2 operate as an oscillator in much the same way as gate G3 and G4 and the output of gate G2 repeatedly switches between a logic 1 and logic zero thus altering the logic state of the first input of gate G3, modulating the output of the oscillator formed by the gates G3 and G4 at the frequency of the oscillator formed by gates G1 and G2. This latter frequency is dependent upon the resistor values R4 and capacitance value of capacitor C2. It may be altered by altering the value of the resistance by connecting a further resistor in parallel with resistor R4, across the external terminals indicated at 24. When the input 23 to G1 is grounded the oscillator formed between G1 and G2 is disabled and the output of G2 is low. This in turn disables the oscillator formed between G3 and G4 and similarly the output of G4 is low. The transistor T1 is therefore switched off and there is no current drain from the battery through the integrated circuit of transistor T1. Consequently the battery can be left permanently connected. The device can then be activated by placing the appropriate potential on inputs 21 or 23. The input gates to the CMOS integrated circuit have impedances of the order of $10^{16}$ Ω and the power involved in generating this switching action is as low as $10^{-14}$ W. This gives great flexibility in the design of systems which will activate the noise unit, for example the electrostatic charge on an insulator held close to the gate wire can be used to activate the alarm. The modulating oscillator formed from gates G1 and G2 may be operated at an audible frequency in excess of 30 KHz as well as at a sub-audible frequency. This effect is to produce sound with the modulating frequency present providing that the modulating frequency is significantly less than that of the main oscillator formed from gates G3 and G4. The lower frequency of the modulating oscillator is most clearly audible when the modulating oscillator runs at one third of the frequency of the main oscillator. This results in every third pulse being gated out of the pulse train fed from the output of gate G4 to the switching transistor.

One advantage of this circuit is that the input to gate G2 from terminal 21 can be tied to earth by a very high resistor, for example 10 M Ω, and to the positive voltage supply by a much lower resistor 25. This much lower resistor may be provided, in a security situation, by a thin wire threaded through articles to be protected or, in a fire alarm system, by a similar fine wire connected between appropriately spaced individual alarms in a building and the battery. If the wire is broken, by an attempted theft in the security situation, or deliberately or by fire, in the fire alarm situation, the second input of the gate G2 is pulled low through the 10 M Ω resistor and the alarm operates as described previously. The advantage of this arrangement is that the alarm system is active and therefore fail safe because of the current flowing through the wire and 10 M Ω resistor. This current is so small, however, that it is of the same order of magnitude as the leakage current of the battery and, providing the alarm is not operated, the life of the battery differs little from its normal shelf life. Thus in a fire alarm system each alarm can be individually fed from its own battery and individual alarms can be connected together only by a very fine wire.

Figure 3:
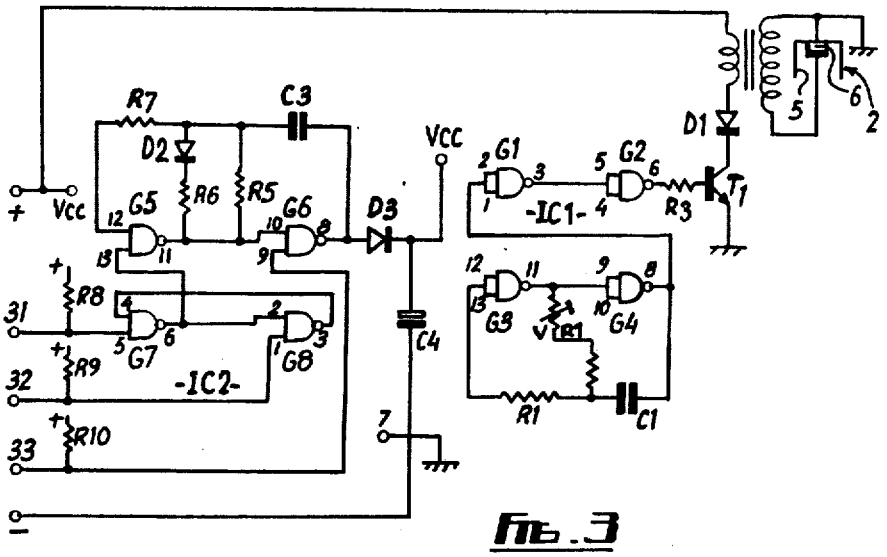
FIG. 3 shows an embodiment employing two CMOS integrated circuits.
Figure 3A:
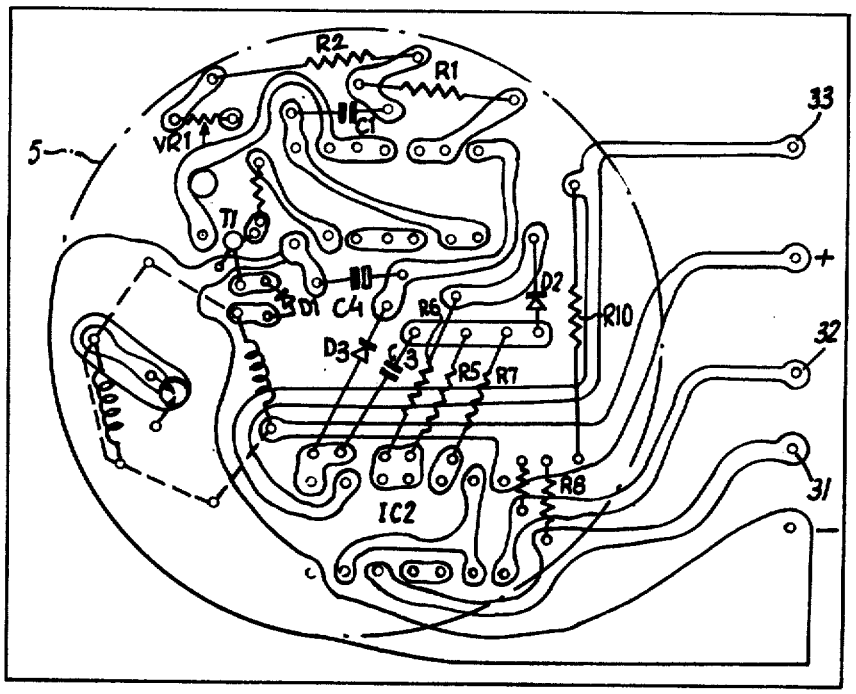
FIG. 3A shows a printed circuit board arrangement appropriate to the circuit of FIG. 3.

FIGS. 3 and 3A illustrate an ambodiment employing two CMOS integrated circuits (here referenced IC1 and IC2) of the type of the embodiments already described. This provides for a siren and a continous tone operation. IC1 is connected in the same way as IC1 of FIG. 1 except that gates G1 and G2 are not required and are tied up by using them as buffers between the output of the oscillator formed by gates G3 and G4 and the base of transistor T1. The supply to IC1 is controlled by IC2. This latter integrated circuit IC2 has two of its gates G5 and G6 connected to run as an oscillator. The frequency of oscillation is determined by the values of resistors $R_7$, $R_6$ and $R_5$ and capacitor C3. The presence of the diode D2 enables the mark-space ratio of the oscillator to be designed as appropriate in that the on-time is controlled by the time constant $(C_3R_5R_6)/(R_5+R_6)$ whilst the off-time is controlled by the time constant $C_3R_5$. Operation of this oscillator is controlled by gates G7 and G8 which are connected as a bistable circuit. Three input terminals 31, 32 and 33 are provided for set siren, clear siren, and continuous tone respectively.

For continuous tone operation logic zero is placed on the second input of gate G6 (pin 9) through terminal 33. This produces logic 1 at the output of the gate G6 charges up capacitor C4 and provides the necessary operating voltage for the oscillator comprising gates G3 and G4 of IC1 through Vcc. This oscillator operates in the same manner as that of the first embodiment; transistor T1 is switched on and off and can 5 is pulsed through the piezoelectric crystal 6.

Siren operation is dependent upon an inherent frequency operating characteristic of the CMOS integrated circuit. Frequency stability is good between the intended operating supply voltage of 18 volts and 6 volts given a suitable value of $R_1$. After this frequency of oscillation of the circuit described using those gates connected as an oscillator falls as the supply voltage falls down to 3 V giving a siren effect. This operating characteristic is utilised in the FIG. 3 embodiment by making the input voltage of the oscillator formed by gates G3 and G4 subject to the charge and discharge of capacitor C4. This capacitor is, as already described, connected to the output of gate G6 through a diode D3. Gates G7 and G8 of integrated circuit IC2 are connected to form a bistable flip-flop. The siren is set or operated by putting logic zero on the second input of G7 (pin 5). This gives logic 1 at the first output of G7 (pin 6). The second input of G8 is tied to the positive rail through a 10 M Ω resistor R9 and when the first input (pin 2) is high the output of gate G8 is therefore logic zero. With the flip-flop in this state logic zero is applied to the second input of gate G5 (pin 13) giving a logic 1 at the output of this gate and therefor also at the first input of gate G6, thus enabling the oscillator formed between G5 and G6 to oscillate. The gates G5 and G6 and associated circuitry of resistors $R_5$ $R_6$, $R_7$ and capacitor $C_3$ operate in a similar fashion to the oscillator formed by the gates G1 and G2 of FIG. 2. When the voltage on the capacitor falls to a point insufficient to maintain a logic 1 at the output of G5 the output at this gate switches to logic zero and the output of gate G6 to logic 1 thus recharging capacitor C3. In this way repetitive square wave voltage waveform of the desired mark-space ratio is applied to the supply terminal Vcc of IC1 and to C4 which discharges giving the siren effect. The diode D3 prevents C4 discharging into the output of gate G6 when this is low. This siren can only be cleared by switching the bistable flip-flop circuit into its other stable state and this can only be done by placing a logic zero on the second input of gate G8 through terminal 32 thus producing a logic 1 at the output of gate G8 and at the first input of gate G7. This in turn produces a logic zero at the second input of gate G5 to turn off the oscillator.

The bistable operation described above is suitable for domestic burglar alarm systems, fire alarms, smoke detectors and general security alarms where it is desirable that the alarm should operate when activated and remain operative even though the activating mechanism is restored to the inactive mode.

Figure 4:
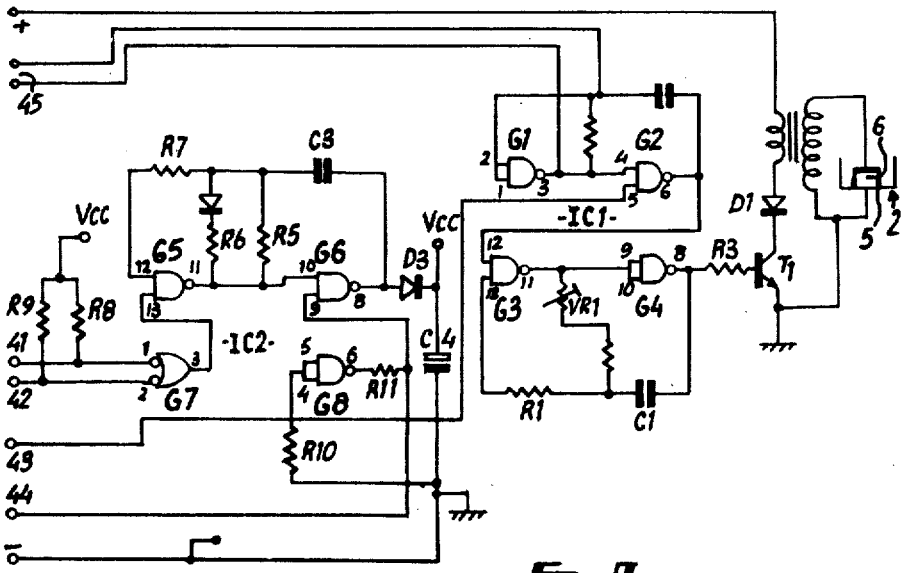
FIG. 4 shows a modification of the embodiment of FIG. 3.
Figure 4A:
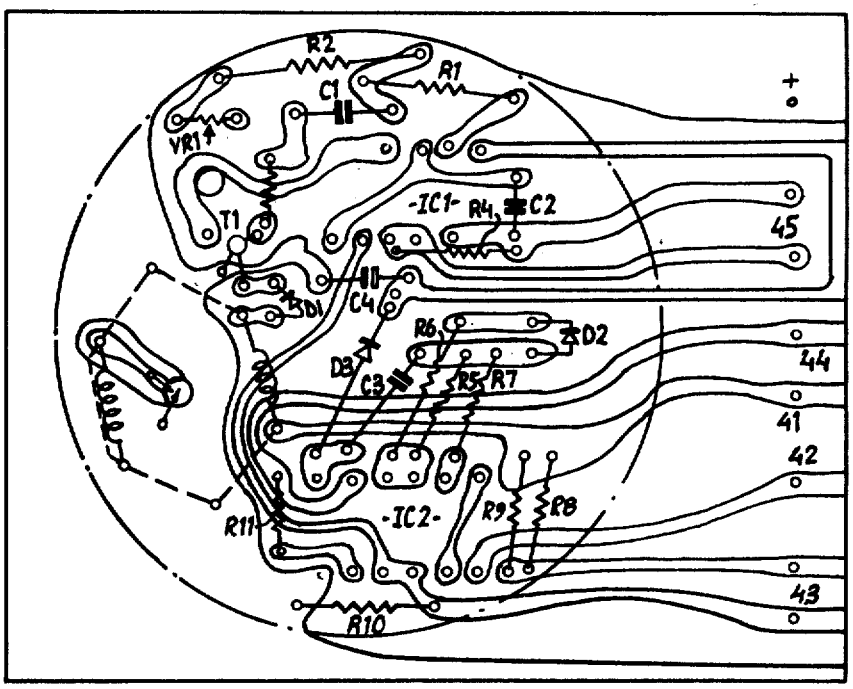
FIG. 4A shows a printed circuit board arrangement appropriate to the circuit of FIG. 4.

FIGS. 4 and 4A show a modification of the circuit of FIGS. 3 and 3A where in addition to a siren and continuous operation pulsed or modulated operation is also provided for. Continuous and pulsed operation is provided by IC1 whose four gates G1 to G4 are connected virtually the same as those of IC1 of the embodiment of FIG. 2. As in this latter embodiment, the pulse rate of pulsed operation may be varied by connecting an additional resistor across terminals 45. Pulsed operation is effected by placing a logic 1 on terminal 43 and continuous operation by placing a logic zero on terminal 44. Siren operation is effected by placing a logic zero on either terminal 41 or 42 respectively.

A further embodiment can be obtained by a small modification of the embodiments depicted in FIGS. 3 and 4 whereby the voltage on capacitor C4 is allowed to rise exponentially to the battery voltage after which it is discharged. The voltage on C4 supplies Vcc for the integrated circuit IC1 as in the previous two embodiments and this results in a frequency which increases exponentially with time with its characteristic sound. This is achieved by charging C4 through a resistor of a suitable value necessary to give the desired time constant for the increase in the frequency. If a slow decline in frequency as was achieved in the previous two embodiments is not required then the resistor is by-passed by connecting a diode in parallel with it in the opposite polarity to that of D3 shown in FIGS. 3 and 4. In the general case the time constants for the off-time, the frequency increase, the maximum frequency and the frequency decrease can be adjusted independently to produce a very wide range in the types of noise produced by the unit.

Figure 5:
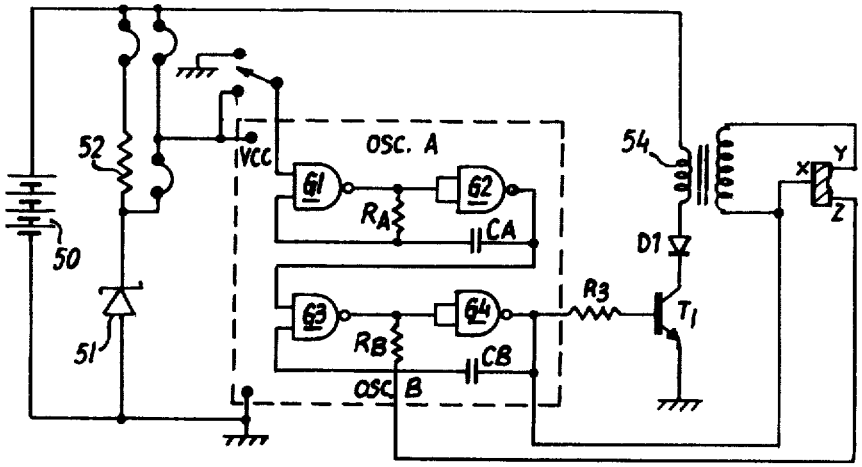
FIG. 5 shows a further embodiment employing a CMOS integrated circuit with feedback from the crystal to the circuit, FIG. 5A diagrammatically shows the fixture of the crystal on the sound resonator and the arrangement of the electrodes.
Figure 5A:
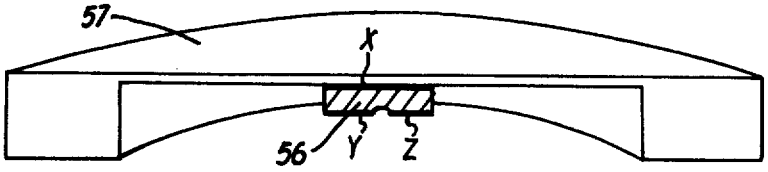

FIGS. 5 and 5A illustrate an embodiment having a piezoelectric crystal in which, in addition to electrodes employed to drive the crystal, a further electrode is provided from which a feedback signal may be derived for transmission back to the oscillator circuit. The circuit includes a single CMOS integrated circuit of the type described in the previous embodiments, that is, it consists of four two input NAND gates. Two of the gates G1 and G2 are connected with a resistor $R_A$ and capacitor $C_A$ to form a modulating oscillator A and the other two gates are connected with a resistor $R_B$ and capacitor $C_B$ to form the main drive oscillator B. The CMOS circuit can be run directly from a battery supply 50 to Vcc or, indirectly, from a zener diode 51 connected in series with a resistor 52 across that supply 50.

The output from oscillator B is fed through a resistor $R_3$ to the base of an NPN transistor T1. The emitter of this transistor is earthed and the collector is connected through a diode D1 to the primary winding of a transformer 54. With certain transformers the diode D1 is unnecessary. The secondary winding of this transformer is connected between two metal electrodes X and Y disposed on opposite sides respectively of a piezoelectric ceramic crystal 56. A third metal electrode Z disposed on the same side of the crystal as the electrode Y leads back to the connection point between the resistor $R_B$ and capacitor $C_B$ of the oscillator B. Referring particularly to FIG. 5A, the physical arrangement of the piezoelectric ceramic crystal is shown. The crystal 56 is sandwiched between electrode X on one side and electrodes Y and Z on the other. The electrode X is connected on its face remote from the crystal to a brass circular diaphragm 57 0.040" thick and 2" in diameter and clamped at its outer edge. The crystal 56 may be of square section or any other section in a plane parallel to the plane of the diaphragm.

In operation of the device, oscillator A is switched on by enabling gate G1 through connection of its first input to Vcc and switched off by disabling gate G1 by connection of its first input to earth. Enabling gate G1 causes oscillator A, and through it, oscillator B to oscillate, transistor T1 to switch repeatedly on and off and a periodically varying voltage to be applied between electrodes X and Y on the crystal 56 as already described in relation to the embodiments of FIG. 2. The regions of the crystal 56 driven by an applied electric field generate stress by the indirect piezoelectric effect. The stress is coupled to other areas of the same crystal and to other crystals bonded to the diaphragm and induced voltages are generated by the direct piezoelectric effect. The amplitude and frequency of these induced voltages are related to the amplitude and frequency of the stress generated in the crystal regions driven by applied electrical signals. The induced signal may be used to control jointly or separately the amplitude and frequency of the driving signal applied between electrodes X and Y. This is done by feeding back the induced signal through electrode Z to oscillator B. The feedback signal is out of phase with the signal applied to the crystal by 90° and thus the peaks and troughs of this signal tend to influence the switching points of gate G4 of oscillator B. Where these switching points are slightly displaced from their optimum position, the feedback signal is responsible for causing them to be aligned with their optimum position resulting in the maximum movement of the diaphragm. This effectively acts as a control locking the value of the frequency of oscillation of oscillator B to the desired value giving the maximum noise output. The required resonant mode of the diaphragm is selected by adjusting the value of resistor $R_B$ which must be varied by more than 25% before the device jumps out of the fundamental mode of oscillation to the next harmonic. The low frequency oscillator A can be run in the range 1 to 30 Hz to simulate slow beating or conventionally beating electric bells. If $R_A$ is adjusted so that the slow oscillator runs at $\frac{2}{3}$ or $\frac{1}{3}$ of the frequency of the fast oscillator a device of lower tone is produced. It helps but it is not essential to run the positive rail of the CMOS circuit from a 4.7 V zener diode as shown in FIG. 5 in order that the frequency of oscillator A is independent of the supply voltage. The use of a zener diode to power the CMOS circuit does enable the device to be operated from large D.C. supplies.

Figure 6:
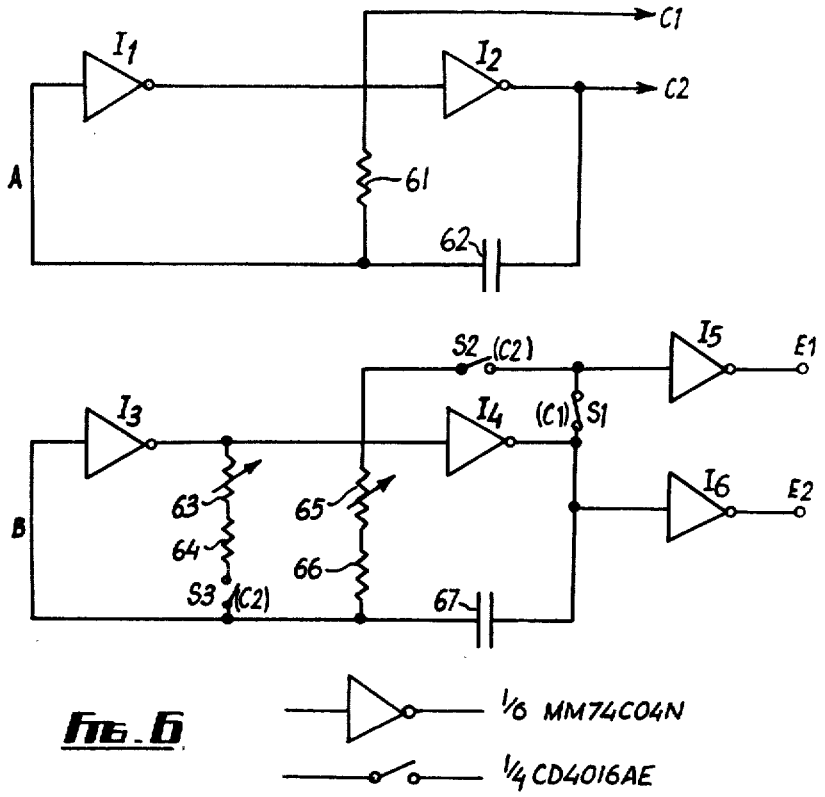
FIG. 6 shows a further embodiment employed in an alternative form of CMOS integrated circuit.

Referring to FIG. 6 a circuit is shown employing a CMOS integrated circuit comprising six inverters. Two inverters $I_1$ and $I_2$, are employed as a first oscillator, two inverters $I_3$ and $I_4$ as a second driving oscillator and the remaining two $I_5$ and $I_6$ act as buffers between the outputs of the second oscillator and two isolated D-shaped metal electrodes applied to one face of a circular piezoelectric crystal which in turn is bonded to a thin circular metal diaphragm clamped at its circumference. The time constant of the first oscillator is provided by a resistor 61 (780 K Ω) and capacitor 62 (1 μF) connected in series across inverter $I_2$. The time constant and oscillation frequency of the second oscillator is dependent upon the position of switch S3. When the switch is closed the effective time constant and oscillation frequency is dependent upon the parallel combination of resistors 63 to 66 and capacitor 67, and, when switch S3 is open, upon the combination of resistor 65 and 66 only and capacitor 67. When S3 is closed so also is a switch S2 which places a signal on the first electrode which is 90° out of phase with that on the other electrode. When S2 and S3 are open, a further switch S1 is closed coupling the electrodes E1 and E2 together and placing the same signal on both. The switches S1, S2 and S3 are all provided by a single MOS integrated circuit chip. The bonded face of the crystal is fully electroded across its whole area and electrically earthed via the diaphragm. The D-shaped metal electrodes E1 and E2 applied to the exposed surface of the piezoelectric crystal are driven by the two electrical signals produced at the output of the second, driving oscillator which when in phase produce a resonant mode of oscillation and audible output at 2.75 KHz, and when driven in antiphase produce a higher harmonic resonance and hence a higher pitched audible signal at 5.20 Khz. The driving signals are produced at the electrodes as follows. The first oscillator comprising inverters $I_1$ and $I_2$ produce antiphase square wave control signals C1 and C2 at a frequency of 1 Hz. The second, driving oscillator is capable of producing either one of two frequencies as already described, the frequency selected depending on the state of the control signals C1 and C2. With the state of the circuit as depicted in FIG. 6, the signals output to the two electrodes are in phase and a resonant mode of oscillation is induced in the circular diaphragm such that the diameter of the diaphragm is approximately one half wavelength of the frequency produced. In the alternate state the two outputs are antiphase at a higher frequency, and a resonant mode of oscillation is induced in the diaphragm such that the diameter of the diaphragm is approximately one wavelength of the frequency produced.

The diaphragm may be a rectangular diaphragm clamped along opposite edges. A rectangular slab of piezoelectric material containing two electrodes are driven by two electrical signals which were either in phase or antiphase and of some frequency producing a resonant mode of oscillation of the diaphragm which vibrated such that an integral number of half wavelengths matched the length and breadth of the diaphragm. For a device with the dimensions shown in FIG. 6 audible outputs were produced at 1.5 kHz, 2.2 kHz, 5.0. kHz, 6 kHz, 7 kHz, 814 kHz, 13.7 kHz and 19.3 kHz which could be sounded in any repetitive time sequence required.

Figure 7:
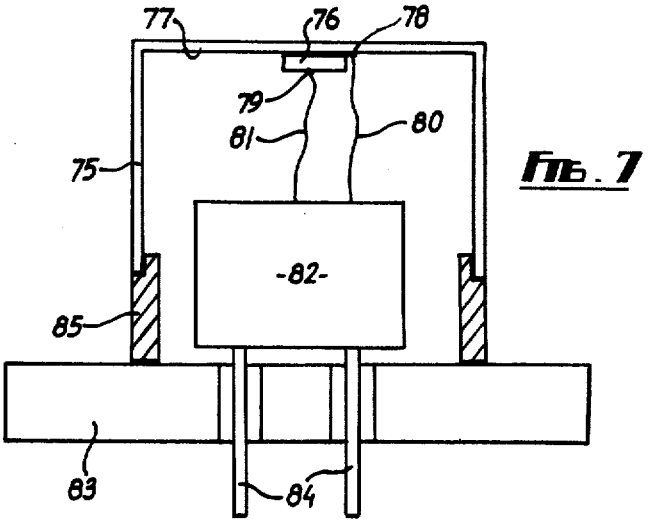
FIG. 7 shows a side sectional elevation of a resonant enclosure.

In the above described embodiments reference has been made in general to the connection of the piezoelectric crystal to the diaphragm. Where the diaphragm forms the end wall of a cylinder or can open at one end of the can or cylinder can be used in a particular advantageous way to enclose all of the circuitry of the device to form a waterproof enclosure. Such an arrangement has clear advantages where the device is to function as a fire alarm or where it is to be disposed in a position open to the elements. FIG. 7 illustrates such an arrangement. Here a brass can 75 has a piezoelectric crystal 76 bonded either by low melting point silver loaded solder or by silver loaded epoxy to the internal surface of the can end face 77. Two electrodes are provided at 78 (earth) and 79 (driving) respectively. These electrodes are joined by flexible leads 80 and 81 to appropriate points on the driving circuit 82. This circuit may adopt any of the forms already described. The can 75 is supported on a solid support 83, through which supply leads 84 are taken to the circuit 82, by means of an expanded plastics foam ring 85. If the ring is of closed cell construction a waterproof enclosure can be produced within the can. The ring provides the required mechanical strength to hold the vibrating can whilst at the same time decoupling the sonic energy imparted to the can by the crystal from the solid support 83. This provides negligible damping of the vibrating object and enables a high acoustic intensity to be achieved. Other materials of a very high compliance may be used for the ring to the expanded plastics foam.

What is claimed is:

1. A sound generator comprising a substantially circular end face, a cylindrical side wall integral with said end face, about the entire circumference of said end face, extending in one direction from said end face, and having a major cylindrical axis perpendicular to said end face, said end face and side wall defining a cylindrical enclosure closed at said end face, and open at the opposite axial end defined by said side wall, a crystal attached to said end face, oscillator means for pulsing said crystal at a pulsing frequency and for vibrating the end face and the integral side wall to generate audible pressure waves from the end face and from the integral side wall.

2. A sound generator as claimed in claim 1 further comprising supporting means for supporting said cylindrical enclosure at said opposite axial end without substantial damping of said cylindrical enclosure.

3. A sound generator as claimed in claim 2, wherein said supporting means further comprises means for enclosing said opposite axial end.

4. A sound generator as claimed in claim 2 wherein said crystal is attached to said end face within the cylindrical enclosure.

5. A sound generator as claimed in claim 1, in which the open end of the cylindrical enclosure is bonded to a ring made of a high compliance material, said ring bonded to a support.

6. A sound generator as claimed in claim 5, in which the material of the ring is expanded synthetic plastics material foam.

7. A sound generator as claimed in claim 5, in which the material of the ring has a closed cell construction to enable the closed cavity formed within the cylindrical enclosure to be made waterproof.

8. A sound generator as claimed in claim 5, in which the oscillator means is contained within the cylindrical enclosure and ring.

9. A sound generator as claimed in claim 5, in which accommodation is provided within the cylindrical enclosure and ring for a battery to supply the oscillator means.

10. A sound generator as claimed in claim 1, in which the oscillator means comprises a CMOS circuit comprising four inverters two of which are connected together with a resistor and capacitor to form a first oscillator and the other two of which are connected with a resistor and capacitor to form a second oscillator which is operative to gate the first oscillator.

11. A sound generator as claimed in claim 10, in which the value of the resistor in the first oscillator may be changed in dependance upon a signal received from the second oscillator whereby the frequency of oscillation of the first oscillator is changed.

12. A sound generator as claimed in claim 1 in which the oscillator means comprises a two-input quad NAND gate CMOS circuit, two of the gates being connected with a resistor and capacitor to form an oscillator and the other two gates being connected for receiving a suitable supply signal at their inputs and for generating and applying a signal to the input of the oscillator to cause it to oscillate.

13. A sound generator as claimed in claim 12, wherein said other two gates being connected to form a bistable flip-flop, the output of which controls the oscillator, the bistable being set or cleared by the application of said suitable supply signal.

14. A sound generator as claimed in claim 12, wherein said other two gates being connected to form a second oscillator, the second oscillator being caused to oscillate on the application of an appropriate input signal and the output of the second oscillator being applied to the input of the first oscillator to cause it to oscillate at a frequency modulated at the frequency of the second oscillator.

15. A sound generator as claimed in claim 1, in which the oscillator means comprises first and second two-input quad NAND gate CMOS circuits, two of the gates of said first circuit being connected with a resistor and capacitor to form a first oscillator, said first oscillator interconnected with said crystal, two of the gates of said second circuit being connected with a resistor and capacitor to form a second oscillator, the other two gates of said second circuit being connected to form a bistable flip-flop circuit, the output of the second oscillator being connected to a capacitor and to a supply rail to the first circuit whereby a repeatedly exponentially declining supply voltage may be applied to the first oscillator in dependence upon the operational state of the flip-flop circuit.

16. A sound generator as claimed in claim 15, wherein the output of the second oscillator is connected through a resistor to said capacitor, said capacitor connected to the supply rail of the first circuit whereby a repeatedly exponentially increasing supply voltage may be applied to the first oscillator in dependence upon the operational state of the flip-flop circuit.

17. A sound generator as claimed in claim 1, in which the oscillator means comprises first and second two-input quad NAND gate CMOS circuits, two of the gates of said first circuit being connected with a resistor and capacitor to form a first oscillator, said first oscillator interconnected with said crystal, the other two gates of said first circuit being connected with a resistor and capacitor to form a second oscillator, two of the gates of said second circuit being connected with a resistor and capacitor to form a third oscillator, the output of the third oscillator being connected to a capacitor and to the supply rail of the first circuit, the other two gates of the said second circuit being connected between operating terminals and inputs of the gates of the third oscillator, whereby on application of appropriate signals at the terminals continuous tone, modulates or repeated pulses of declining frequency may be provided at the output of the first oscillator.

18. A sound generator as claimed in claim 1, in which the oscillator means comprises first and second two-input quad NAND gate CMOS circuits, two of the gates of said first circuit being connected with a resistor and capacitor to form a first oscillator, said first oscillator interconnected with said crystal, the other two gates of said first circuit being connected with a resistor and capacitor to form a second oscillator, two of the gates of said second circuit being connected with a resistor and capacitor to form a third oscillator, the output of the third oscillator being connected through a resistor to a capacitor, said capacitor connected to a supply rail of the first circuit, the other two gates of said second circuit being connected between operating terminals and inputs of the gates of the third oscillator, whereby on application of appropriate signals at the terminals continuous tone, modulated or repeated pulses of increasing frequency may be provided at the output of the first oscillator.

19. A sound generator as claimed in claim 15, in which means are provided enabling the supply rail of the second circuit to be supplied with a repetitive exponential rise and fall of voltage.

20. A sound generator as claimed in claim 1, in which the oscillator means is connected to pulse the crystal through a power amplifier and step up transformer.

21. A sound generator as claimed in claim 20, in which the power amplifier is an NPN transistor connected in the grounded emitter mode.

22. A sound generator as claimed in claim 1, in which the crystal is a piezoelectric crystal.

23. A sound generator as claimed in claim 1, in which the crystal is circular in a plane parallel to the plane of the member to which it is attached.

24. A sound generator as claimed in claim 1, in which the crystal is rectangular in a plane parallel to the plane of the member to which it is attached.

25. A sound generator as claimed in claim 1, in which the crystal is bonded to the member to which it is attached by a silver loaded solder.

26. A sound generator as claimed in claim 1, in which the crystal is bonded to the member to which it is attached by means of a conductive epoxy resin.

27. A sound generator as claimed in claim 24, wherein the planar area of the rectangular crystal is substantially less than the planar area of the member to which it is attached.

28. A sound generator as claimed in claim 1, further comprising feedback means for locking the frequency of the oscillator means to the vibration frequency of the surface of the cylindrical enclosure comprising means for feeding back to the oscillator means a feedback voltage proportioned to the vibration frequency of the cylindrical enclosure.

29. A sound generator as claimed in claim 28, wherein said feedback voltage is derived by isolating an area of one of the crystal faces, wherein the crystal vibration is converted to a voltage.

30. A sound generator as claimed in claim 28, wherein said feedback voltage is derived by attaching an additional crystal to the closed end of the cylindrical enclosure and feeding back the voltage generated by the vibration of the additional crystal.

* * * * *